US006698061B2

(12) United States Patent
Ho

(10) Patent No.: US 6,698,061 B2
(45) Date of Patent: Mar. 2, 2004

(54) FASTENING DEVICE FOR A SHOWER CURTAIN

(76) Inventor: Stanley Ho, 18 Nottingham Way, Warren, NJ (US) 07059

( * ) Notice: Subject to any disclaimer, the term of this patent is extended or adjusted under 35 U.S.C. 154(b) by 57 days.

(21) Appl. No.: 09/988,114

(22) Filed: Nov. 16, 2001

(65) Prior Publication Data

US 2003/0093874 A1 May 22, 2003

(51) Int. Cl.[7] ..... E05D 15/00

(52) U.S. Cl. ..... 16/87.2; 16/87.8; 16/87.6 R

(58) Field of Search ..... 16/87.2, 87.6 R, 16/87.8; 160/330, 352, DIG. 6; 4/558, 608, 610; 24/716; 248/316.1, 316.4, 316.6, 316.7

(56) References Cited

U.S. PATENT DOCUMENTS

| | | | | | |
|---|---|---|---|---|---|
| 272,772 | A | * | 2/1883 | Rieger | 160/368.1 |
| 279,236 | A | * | 6/1883 | Fletcher | 24/364 |
| 686,124 | A | * | 11/1901 | Parker | 16/87.2 |
| 722,370 | A | * | 3/1903 | Leslie | 16/87.8 |
| 940,642 | A | * | 11/1909 | Maass | 24/716 |
| 2,008,471 | A | * | 7/1935 | Schroeder | 160/390 |
| 2,302,341 | A | * | 11/1942 | Nash | 24/479 |
| 2,320,308 | A | * | 5/1943 | Sliverman | 16/87.2 |
| 2,652,586 | A | * | 9/1953 | Ramsberger | 16/87.2 |
| 2,711,555 | A | * | 6/1955 | Hanson | 16/87.2 |
| 4,010,503 | A | * | 3/1977 | Denton | 16/87.2 |
| 4,675,939 | A | * | 6/1987 | Fukada | 16/87.2 |
| 4,955,422 | A | | 9/1990 | Irizarry | |
| 5,310,052 | A | | 5/1994 | Bindman | |
| 5,339,884 | A | | 8/1994 | Angerman | |
| D350,279 | S | * | 9/1994 | Tate | D8/373 |
| 5,355,551 | A | | 10/1994 | Schechter et al. | |
| 5,367,742 | A | | 11/1994 | Bindman | |
| 5,651,407 | A | | 7/1997 | Perez | |
| 5,771,504 | A | | 6/1998 | Steiner | |
| 5,787,954 | A | | 8/1998 | Herrera | |
| 5,894,642 | A | | 4/1999 | Eberhardt | |
| 6,067,672 | A | | 5/2000 | Klotz | |
| 6,189,597 | B1 | | 2/2001 | Cheng | |

FOREIGN PATENT DOCUMENTS

| | | | |
|---|---|---|---|
| GB | 2079143 A | * | 1/1982 |
| JP | 8-103367 | * | 4/1996 |
| JP | 10-257961 | * | 9/1998 |

* cited by examiner

*Primary Examiner*—Chuck Y. Mah
(74) *Attorney, Agent, or Firm*—Frommer Lawrence & Haug LLP

(57) ABSTRACT

Claimed and disclosed is a fastening device that can fasten itself to a sheet material and at the same time couples itself to an object, comprising a coupling means for slidably coupling the device to a substantially fixed object and an attachment means for attaching the sheet material to the device. The coupling means defines a receiving surface at a first portion and has an extended second portion thereof which is rotatably connected to an attachment means for attaching an object to the device. The attachment means comprising two elongated outer members connected by a bridge, a first outer member comprising an extending member on its interior surface and extends toward a corresponding recess disposed on an interior surface of a second elongated outer member. The bridge of the attachment means defines a recess with a sleeve to receive the extended second portion of the coupling means to form the fastening device as claimed and disclosed in the present invention.

13 Claims, 16 Drawing Sheets

FASTENING DEVICE FOR A SHOWER CURTAIN

FIELD OF THE INVENTION

The present invention relates to a fastening device. More specifically, the present invention teaches and discloses a shower curtain connector that has, at its first end, a fastener to receive an aperture of a sheet material, preferably a shower curtain and, at its second end, a coupling means such as a curved hook that can hang on a shower curtain rod. The fastening device can be sized and colored as desired and can be made from any material that is flexible, springy yet sturdy and afford a degree of rigidity. Thus, it can be made from any plastic, resin, metal, synthetic or natural material, and/or part plastic and part metal. Therefore, it can withstand repeated use by a user using it on a daily basis without breaking or cracking and at the same time it is sturdy enough that it is capable of holding up a sheet material such as shower curtain and to block water from spilling outside of a bathtub. More particularly, the fastening device of the present invention has two ends, a coupling means and an attachment means. The first end is an attachment means that has a bridge connecting two elongated members, one member has an extending member from its interior surface, wherein the second elongated member has a corresponding recess disposed on its interior surface, whereby when the attachment means is in use, the extending member is matingly fitted with the recess. The bridge is further comprised of a recess to receive a second end of a coupling means. The coupling means defines a receiving surface at a first portion thereof, and an extended second portion thereof. The receiving surface of the coupling means slidably couples to a substantially fixed object. The coupling means can be in any shape made from any material in any color and it can optionally have bearings and/or beads in any shape made from any material to facilitate the sliding motion on a substantially fixed object, namely a rod. The extended second portion of the coupling means is matingly fitted with the recess disposed on the bridge connecting two elongated members to form the fastening device as claimed and disclosed. The attachment means of the shower curtain connector can be rotatable or optionally stationary. Consequently, when a user is hanging up a shower curtain, he or she no longer has to hover over the bathtub and struggle for a secure non-slippery surface in the bathtub for a strong foothold to try to secure the shower curtain rings first to the shower curtain rod and then try to connect the shower curtain to the shower curtain rings. A user can now leisurely connect the fastening device to a sheet of material, i.e., a shower curtain, then walk over to the bathtub and hang up the shower curtain as if hanging a hanger on a rod without risking standing on a small slippery surface. In addition, the fastening device of the present invention is safely secured to and rests on the shower curtain rod since the coupling means preferably has a U-shaped hook and thus, would not and cannot be easily removed from the rod. In addition, since the shower curtain is secured between the extending member that is matingly fitted with a recess, it is not likely that the shower curtain will become separated and/or loose from the fastening device after repeated use.

The fastening device may also have coupling means in various shapes and forms. For example, the coupling means can be in the shape of a circular ring, or an oval ring having a locking mechanism or in an "S" shape to facilitate easy assembling. The coupling means can also optionally have at least one bearing and/or beads in the shape of a circle and/or a rectangle opposite the receiving surface in order to facilitate movement of the fastening device on the rod.

Accordingly, the present invention can relate to a coupling device, connecting a sheet material to a substantially fixed object such as a rod, and it can be made from any material that is flexible yet sturdy with a degree of rigidity. Optionally, it can have bearings and/or beads to facilitate movement of the coupling means on the rod. The coupling means can be any color and can optionally have at least one decorative ornamentation in order to match the decor of its environment.

Various documents may be mentioned in this text; and, each herein mentioned document and each document cited or referenced in each herein mentioned document, is hereby incorporated herein by reference.

BACKGROUND OF THE INVENTION

Shower curtain rings have been in existence for a long time and they come in all shapes and sizes and are made from all different kinds of material. Ultimately, all of these shower curtain rings serve the same purpose of causing the shower curtain to remain in an upright and vertical position while in use, thus keeping water confined to the interior of the bathtub and providing a vertical wall between a bathtub and the rest of the bathroom environment. Over the years, various shower curtain rings having different shapes and made from different materials have been introduced into the market, but no matter what the new design is, the "newly-developed" shower curtain rings always require a user to assemble the shower curtain by either standing within the bathtub or on the edge of the bathtub, hovering over the edge of the bathtub to first line up the apertures in the shower curtain, then threading the shower curtain rings through the apertures, and then securing the shower curtain rings holding the shower curtain to the shower curtain rod. In short, whenever a user is setting up a shower curtain over a bathtub, he or she inevitably, through conventional shower curtain rings, must complete hanging the shower curtain by attaching the assembly of the shower curtain rings first to the shower curtain then to the rod. Contrary to the known conventional shower curtain rings, the fastening device of the present invention can be utilized anywhere without requiring the user to stand over the bathtub when installing a shower curtain. Thus, a user can leisurely attach each individual fastening device first to a sheet material, such as a shower curtain, by placing each of the apertures of the shower curtain between the extending member and the recess of the attachment means and locking the sheet material in place by forcing the extending member into the recess. This is repeated until all the apertures of the shower curtain are connected to the fastening device of the present invention. Once the fastening devices are secured to the shower curtain, a user can assemble the shower curtain by hanging each of the fastening devices to a rod. Furthermore, the attachment means of the present invention is optionally rotatable, thus, during shipping the coupling means parallel the attachment means, and when in use the coupling means are perpendicular to the attachment means. Moreover, the coupling means end of the fastening device is capable of independent movement from the attachment means.

With respect to shower curtain rings, reference is made to the following:

Cheng, U.S. Pat. No. 6,189,597 B1 issued Feb. 20, 2001, relates to a hanger ring assembly for a curtain. More specifically, it relates to a curtain with a hanger ring assembly for mounting onto a supporting rod which includes a sheet material and a plurality of hanger units. The sheet material has a plurality of hanger openings formed along a top edge, and a plurality of edge gap each extending from the top edge to an upper portion of the respective hanger opening. Each of the opening portions defines a section of connecting tab adjacent to the respective edge gap. Each of the hanger units includes a hanger ring which has a ring slit separating two ends thereof and defines a section of ring tab adjacent to the ring slit. Each of the hanger rings is attached to one side of the respective opening portion and coaxially extended around the respective hanger opening with the ring slit of the respective hanger ring staggering with the edge gap of the respective opening portion. The connecting tabs of the opening portions of the sheet material are detachably overlapped with the ring tabs of the hanger rings respectively. Each of the hanger units further includes a connecting device for selectively connecting each of the ring tabs with the respective connecting tabs. Thus, the hanger ring assembly according to Cheng attached a curtain directly to a supporting rod without any connectors.

Klotz, U.S. Pat. No. 6,067,672 issued May 30, 2000, relates to a shower curtain closure assembly for semi-permanent securement of an edge of a curtain to a wall of a shower enclosure. The closure assembly includes a clamping structure which comprises a mounting bar for permanent securement to a wall of a shower enclosure. The mounting bar includes a wall attachment surface for attachment to a wall of a shower enclosure and a first clamping surface. The mounting bar further includes a plurality of first fastener receiving holes. Supported on the mounting bar is an adjustable clamp including a second clamping surface which is disposed adjacent to the first clamping surface. The adjustable clamp includes a plurality of second fastener receiving holes. The first fastener receiving holes of the mounting bar are aligned with the second fastener receiving holes of the adjustable clamp. A plurality of threaded fasteners are disposed such that a threaded fastener engages each of the aligned first and second holes for securing the adjustable clamp to the mounting bar. A first curtain edge is disposed between the first and second clamping surfaces. The fasteners may be selectively tightened from a first position where the adjustable clamp is loosely secured to the first clamping surface such that the first curtain edge may be easily disposed between the first and second clamping surfaces, to a second waterproof position where the fastener is under tension and applies a compressive clamping force on the first and second clamping surfaces as well as the intervening first curtain edge. The compressive clamping applied to the first curtain edge by the fastener in the second position exceeds the shear strength of the curtain such that a force which exceeds the shear strength of the curtain applied to the curtain first edge will result in the tearing of the curtain before the release of the edge of the curtain from the position between the first and second clamping surfaces.

Eberhardt, U.S. Pat. No. 5,894,642 issued Apr. 20, 1999, relates to a hook and loop hanger for a shower curtain and a liner. More specifically, it relates to a flexible elongated combination shower curtain and liner hanger device with reinforced apertures in an upper region for hanging the hanger element from a shower rod by hooks. The lower region of the hanger device has loop strips in both sides for fastening of the shower curtain and the shower liner to a horizontal rod by hook strips on their upper edges. The hanger device can be clear or colored to match the color of the shower curtain and shower liner.

Herrera, U.S. Pat. No. 5,787,954 issued Aug. 4, 1998, relates to a shower curtain ring whereby each ring includes a body member that encircles the shower curtain rod, the body member having a first end and a second end; a first end locking member which is attached to the first end of the body member and includes a male locking protrusion, where the male locking protrusion comprises a central body portion and a horizontal bar having an enlarged outer tip, the horizontal bar being attached to the central body portion; and a second end locking member which is attached to the second end of the body member and includes a female locking receptacle, the female locking receptacle being adapted to receive and hold the male locking protrusion. The upper edge of the shower curtain is held between the male locking protrusion and the female locking receptacle of each shower curtain ring, whereby the curtain is deformed and held between the male locking protrusion and the female locking receptacle without any part of the shower curtain ring passing through the shower curtain.

Steiner, U.S. Pat. No. 5,771,504 issued Jun. 3, 1998, relates to a shower curtain rib apparatus for use with a conventional bathtub shower curtain which prevents the curtain from being drawn into the shower enclosure when the shower is in use. The apparatus has a plurality of semi-rigid ribs which are vertically oriented and connected to the shower curtain rod. The lower end of the ribs are secured to the tub and the outer surface of the curtain is secured to the ribs, thus preventing the curtain from moving inward. By securing the ribs so that they bow outward, the shower enclosure can be enlarged.

Perez, U.S. Pat. No. 5,651,407 issued Jul. 29, 1997, relates to a shower curtain loop that is permanently attached to the shower curtain on one side, preferably by stitching. The other end of the loop fastens to the curtain with hook and loop fasteners, which facilitate the removal of the curtain and loops from a shower curtain rod. The loop is reinforced with a rigid, flexible member which runs along the length of the loop. This member, which is preferably made of plastic, provides rigidity to the loop so that the loop can easily traverse a curtain rod when the curtain is opened or closed.

Bindman, U.S. Pat. No. 5,367,742 issued Nov. 29, 1994, relates to a click-lock ring for use in hanging shower curtains designed in the form of a split ring wherein one end of the split ring contains a stepped anchoring recess formed from two cooperating lateral openings for receiving a locking head formed at the other end of the split ring. The ring is produced by injection molding a flexible plastic material in a cam-free mold.

Schechter et al., U.S. Pat. No. 5,355,551 issued Oct. 18, 1994, relates to a scent-releasing shower curtain ring. More specifically, it relates to a curtain ring having a fragrance-releasing material mounted on its inner diameter. The material is selected so that the fragrance will only be released when the consumer opens or closes the curtain, that is, only when the material is rubbed against the curtain rod.

Angerman, U.S. Pat. No. 5,339,884 issued Aug. 23, 1994, relates to a shower curtain ring which has a flexible body adapted to encircle a curtain rod and close by frictionally interengaging end members. One of the end members includes an elongated part which is received through an opening along the top edge of the curtain. A flange on the end of the elongated part retains the curtain even when the end members are not engaged.

Bindman, U.S. Pat. No. 5,310,052 issued May 10, 1994, relates to a shower curtain ring package. More specifically, it relates to a unitary totally transparent package of shower curtain rings comprising a stack of ring-like articles, each of which articles has at least one predetermined discontinuity therein, said discontinuities being aligned one with the other in a manner whereby each of the articles in the stack is congruently aligned with the other; a cylindrical transparent PVC cap element disposed tightly over the uppermost ring-like article in intimate contact therewith; an elongated tubular transparent polyvinyl chloride plastic sleeve enveloping the stack of rings from top to bottom and being shrunken into intimate contract with the outer surfaces of each of said rings and said cap to provide a package having a corrugated appearance and providing visual access to the inner and outer portions of said entire stack of rings.

Irizarry, U.S. Pat. No. 4,955,422 issued Sep. 11, 1990, relates to a shower curtain operating mechanism for opening and closing a shower curtain without grabbing on the curtain material. A pull cord system is incorporated into a conventional shower curtain assembly so that the curtain can be opened or closed with minimum stress on the curtain material.

Each of these patents provides a method of attaching a shower curtain to a rod or securing the shower curtain to the bathtub or inner wall of the bathtub. However, none of these patents claims or discloses, teaches or suggests an apparatus capable of attaching the shower curtain to a rod without having the user have to assemble the connection between the shower curtain and the shower curtain ring and then the shower curtain ring to the shower curtain rod all in one setting while standing on the edge of the bathtub.

Thus, it is believed that heretofore the present invention has not been taught or suggested.

OBJECTS AND SUMMARY OF THE INVENTION

It is therefore an object of the invention to provide a novel fastening device.

It is also an object of the invention to provide a fastening device which is suitable to connect to a sheet material and couple the sheet material to a substantially fixed object.

It is yet a further object of the invention to provide an apparatus for coupling to an object, comprising coupling means for slidably coupling the apparatus to a substantially fixed object.

It is still yet another object of the invention to provide a connector that can fasten a sheet material at one end and slidably couple to a substantially fixed object.

It is still further yet an object of the invention to provide a fastening device that can be used to first attach itself to a sheet material, then simultaneously couple to a shower curtain rod so, a user can assemble the sheet material, preferably a shower curtain, to a shower curtain rod without standing on the edge of the bathtub when connecting the shower curtain to the rod through a shower curtain ring.

Thus, the present invention provides a fastening device comprised of an attachment means to attach itself to a sheet material and a coupling means for slidably coupling itself and the sheet material to a fixed object. The fastening device can be made from any material such as plastic, or resin from blow-molding or injection molding; alternatively, it can be made by any metal or a combination of plastic, or resin with metal or any synthetic or any artificial material. The fastening device is comprised of two parts. The first part is comprised of an attachment means having a bridge connecting between two elongated members, the first elongated member has an extending member and the second elongated member has a correspondingly recess that, when the attachment means of the fastening device is in use, the extending member is matingly engaged with the recess. The second part of the fastening device is comprised of a coupling means to slidably couple to a substantially fixed object. The coupling means can be shaped as a half-oval so as to securely attach itself to a substantially fixed object. It can be S-shaped. Alternatively, the coupling means can be shaped as a circle or an oval ring made from two halves connected at one end by a hinge, and at the other end by a locking mechanism that is generally comprised of two engaging parts, one has a protrusion and the other, a corresponding recess to receive the protrusion. In addition, the circular and/or the oval shape coupling means also have an extended second portion having a narrowed portion and a slightly enlarged bulbous head to matingly engage with the recess on the attachment means. Furthermore, the coupling means may optionally have at least one ball bearing and/or beads in any shape disposed on the outer surface of the coupling means preferably opposite the receiving surface of the coupling means to facilitate the movement of coupling means on the substantially fixed object. Furthermore, the coupling means may also have a different shape or form and be made from any material and in any color in order to match with the decor of the environment it is in.

In a preferred embodiment of the invention, the coupling means will be shaped as half of an oval having its center of gravity positioned at the quarter point of the oval and the weight of the sheet material will force the coupling means to slidably couple to a substantially fixed object and maintain its balance.

In another embodiment, the coupling means is in an "S" shape and optionally having at least one bead disposed on the opposite surface of the receiving surface of the coupling means to facilitate smooth movement of the fastening device to the substantially fixed object.

In yet another embodiment, the coupling means is in a circular and/or an oval shape that is formed by connecting two half circles and/or two half ovals connected by a hinge on one side and a locking mechanism on another. The locking mechanism is generally comprised of two engaging surfaces, one having a protrusion and the other having a recess to receive the protrusion. The exterior surface of the receiving surface of the coupling means optionally has beads disposed on it in order to facilitate the sliding motion of the coupling means, hence the fastening device with a sheet material, preferably a shower curtain, to slide easily on a substantially fixed object, preferably a shower curtain rod.

In a preferred embodiment, the attachment means is attached to a coupling means through a recess disposed on the bridge of the attachment means and this enables the attachment means to be rotatably attached to the coupling means. Thus, in addition to connecting the sheet material, preferably a shower curtain, to a substantially fixed object, it can also minimize shelf space when packaged for sale by rotating the attachment means to be on the same plane with the coupling means.

In this text, the terms "comprising", "comprise", "comprises" and the other forms of "comprise" can have the meaning ascribed to these terms in U.S. Patent Law and can mean "including", "include", "includes" and other forms of "include".

These and other objects and embodiments of the invention are provided in, or are obvious from, the following detailed description of the invention.

BRIEF DESCRIPTION OF THE DRAWINGS

In the following detailed description of the invention, reference will be made to the accompanying drawings, incorporated herein by reference, wherein.

DETAILED DESCRIPTION OF THE INVENTION

Figure 1:
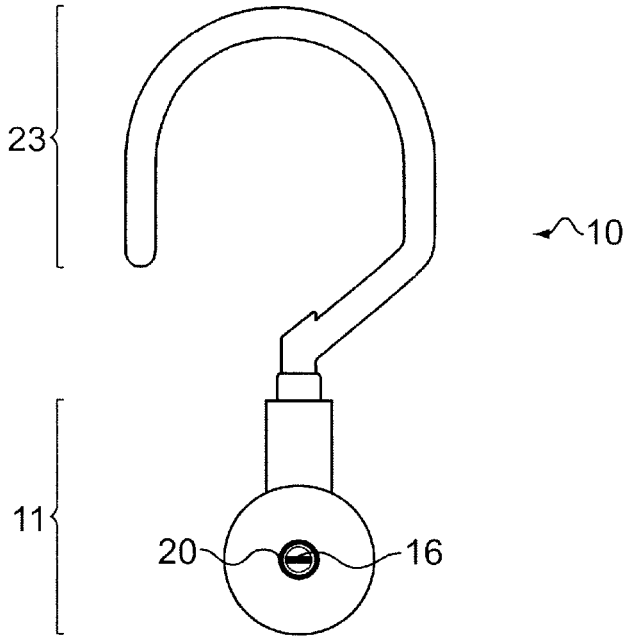
FIG. 1 shows a front view of the first embodiment of the fastening device.
Figure 2:
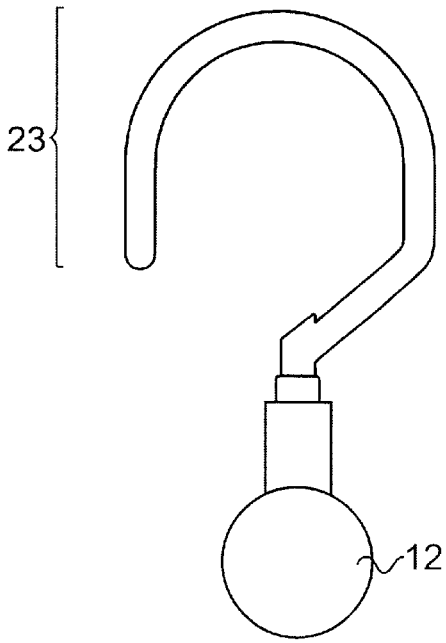
FIG. 2 shows a rear view of the fastening device.
Figure 3:
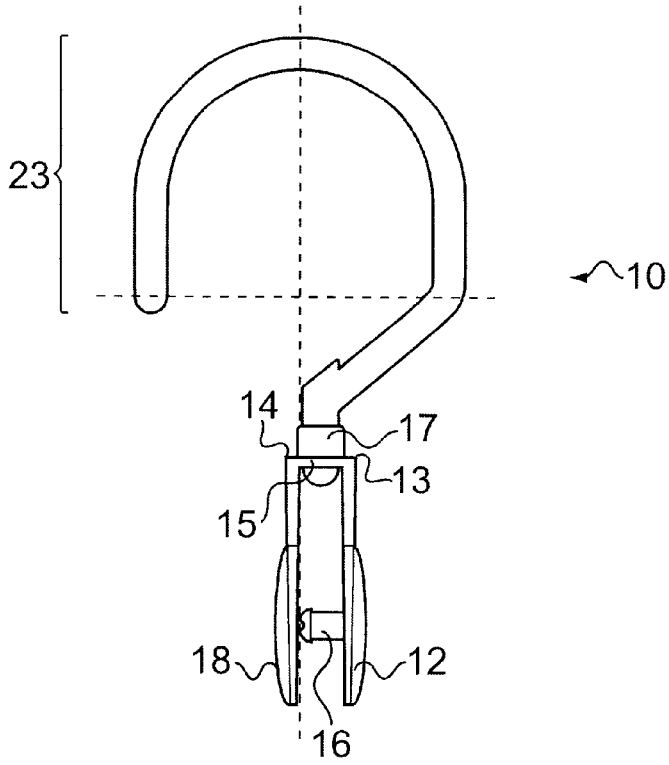
FIG. 3 shows a front view of the fastening device wherein the attachment means is rotatable and perpendicular to the coupling means.
Figure 4:
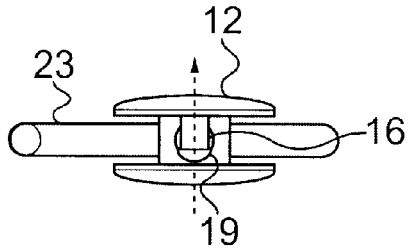
FIG. 4 shows a bottom view of the fastening device.
Figure 5:
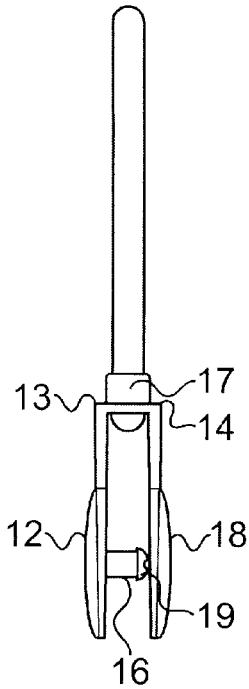
FIG. 5 shows a left view of the fastening device wherein the attachment means parallels the coupling means.
Figure 6:
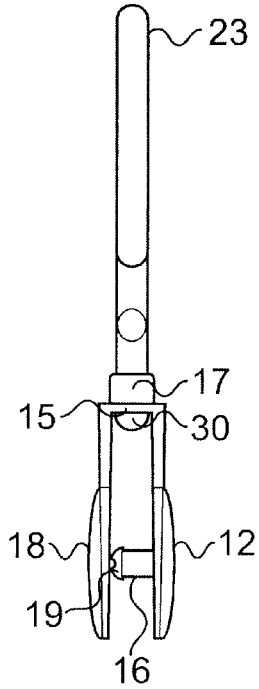
FIG. 6 shows a mirror image of FIG. 5 wherein the attachment means parallels the coupling means.

Reference is made to all of the Figures herein as preferred embodiment. FIG. 1 shows a fastening device 10 having a coupling means 23 and an attachment means 11 comprised of an extending member 16 matingly engaged with recess 20. FIG. 2 shows the front side of the fastening device 10 wherein the attachment means 11 is comprised of a first elongated member 12 having an extending member 16 on an interior surface of the first elongated member 12. FIG. 3 shows an exploded side view of the embodiment 10 having a half oval-shape coupling means 23 removably attached to an attachment means having a sleeve 17 disposed on a recess 21 which is positioned on a bridge 15, and first ends of the first and second elongated members 13 and 14 connected by the bridge 15. There is an extending member 16 protruding from the inside surface of the second end of the first elongated member 12. The extending member 16 has a bulbous head 19 that has a circumference slightly larger than recess 20 in order to ensure a tight fit between the extending member 16 and recess 20. Recess 20 is disposed on the inside surface of the second end of the second elongated member 18. It is important to note that the attachment means 11 is attached to the extended second portion 31 of the coupling means 23 and the attachment means 11 is positioned halfway through the coupling means in order to properly balance the fastening device to a substantially fixed object when the fastening device is fastened to a sheet material. FIG. 4 shows a bottom view of the apparatus of the present invention whereby bulbous head 19 of the extending member 16 is not engaged to a recess 20. However, the extending member 16 is attached to an interior surface of the second end of the first elongated member 12. FIG. 5 shows a left view of the fastening device in accordance with the present invention wherein the sleeve 17 of bridge 15 receives an extended second portion 31 of coupling means 23 through recess 21. FIG. 5 also shows the first ends of the two elongated members 13 and 14 respectively connected itself to the two ends of bridge 15, and the second ends of the two elongated members 12 and 18 further having an extending member 16 and its bulbous head 19 protruding from the interior surface of the second end of the first elongated member 12. FIG. 6 shows a mirror image of FIG. 5 wherein the coupling means 23 is shown to be attached to the attachment means 11 through sleeve 17 and recess 21 and the extended second portion 31 has a bulbous head 30 piercing bridge 15 through recess 21. The attachment means 11 is also comprised of two elongated members having an extending member 16 and a recess 20 on the interior surfaces of the second end of the elongated members 12 and 18.

Figure 7:
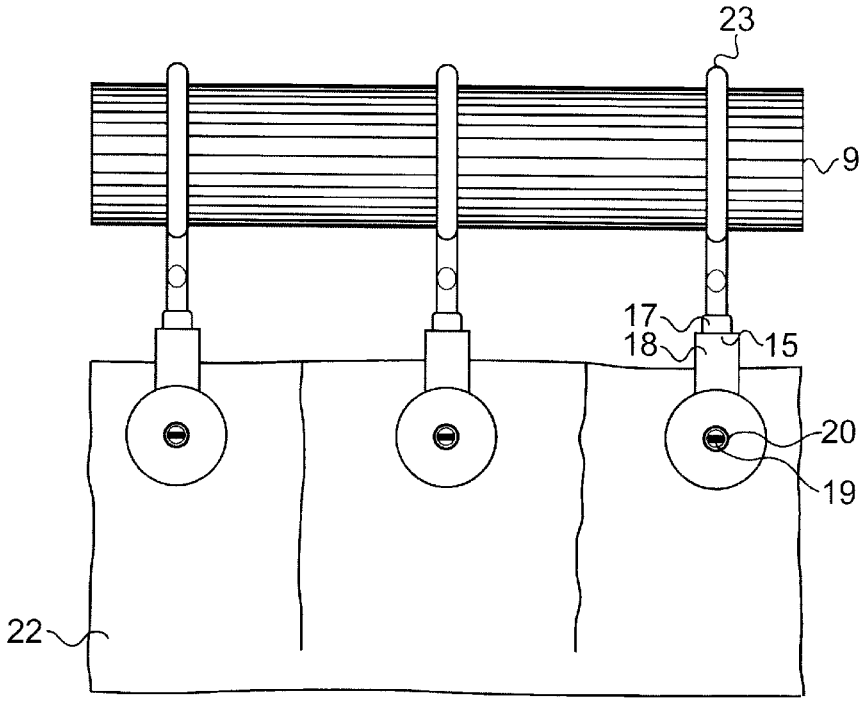
FIG. 7 shows a view from the bathtub whereby the fastening device is connected to a sheet material at one end and slidably attached to a substantially fixed object at a second end.
Figure 8:
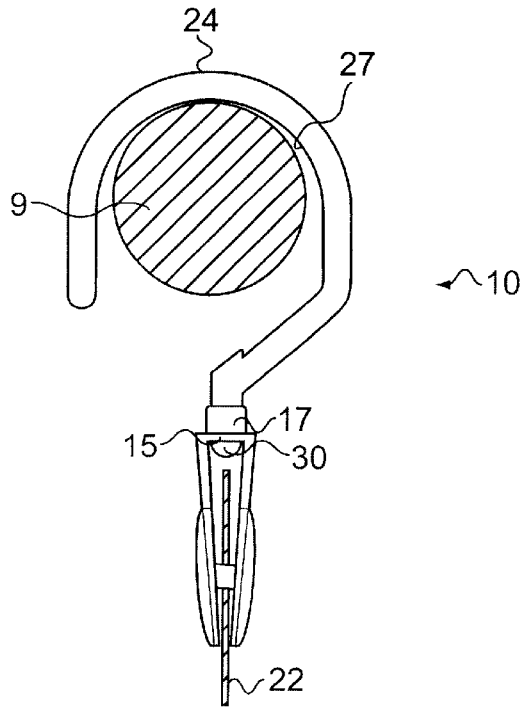
FIG. 8 shows a side view of the fastening device wherein the attachment means is rotatable and is perpendicular to the coupling means that is slidably coupled to a substantially fixed object at one end and connected to a sheet material via the attachment means.

FIG. 7 shows a view from within the bathtub wherein the fastening device 10 of the present invention is slidably coupled to a substantially fixed object 9 via the coupling means 23. The fastening device 10 further shows that its attachment means 11 is removably attached to the extended second portion 31 of the coupling means 23 via sleeve 17 and recess 21 disposed on bridge 15. The sheet material 22 is attached to the attachment means 11 by the extending member 16 piercing through the sheet material 22 and matingly engaging the extending member 16 with recess 20 disposed on the interior surface of the second end of the second elongated member 18. FIG. 8 shows a side view of FIG. 7 and specifically, the extending member 16 penetrating the sheet material 22. The coupling means 23 substantially encircles the substantially fixed object 9 and the coupling means 23 is further comprised of a receiving surface 27 which is approximately midway of the coupling means 23 and directly contacts the substantially fixed object 9. The receiving surface 27 is opposite the exterior surface 24 of a first portion of the coupling means 23. FIG. 8 also shows the extended second portion 31 attached to the attachment means 11 by introducing the extended second portion 31 with a bulbous head 30 through sleeve 17 and recess 21 disposed on bridge 15 of the attachment means 11.

Figure 9:
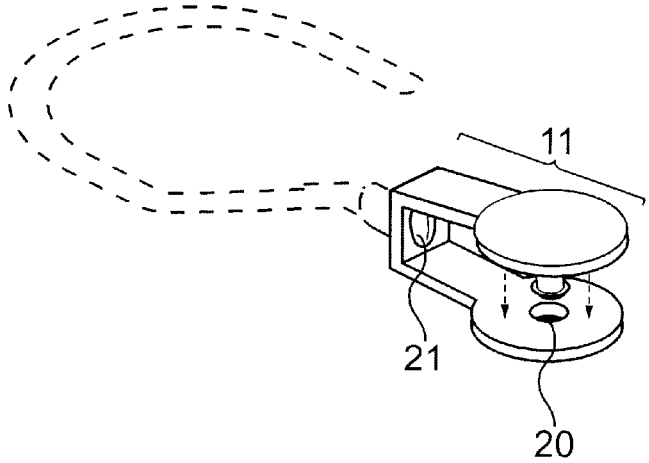
FIG. 9 shows an exploded topside view of the attachment means whereas the extending member is separated from the recess.

FIG. 9 shows an exploded topside view of the attachment means 11 showing the coupling means 23 in dash lines. The attachment means 11 has a recess 21 disposed on bridge 15 and two elongated members have their first ends 13 and 14 respectively attached to the edges of the bridge 15 and optionally forms a right angle with the bridge 15 to provide space between the elongated members. Elongated member 12 has an extending member 16 attached to its exterior surface, a recess 20 disposed on the second end of the second elongated member 18 to correspondingly receive the extending member 16.

Figure 10:
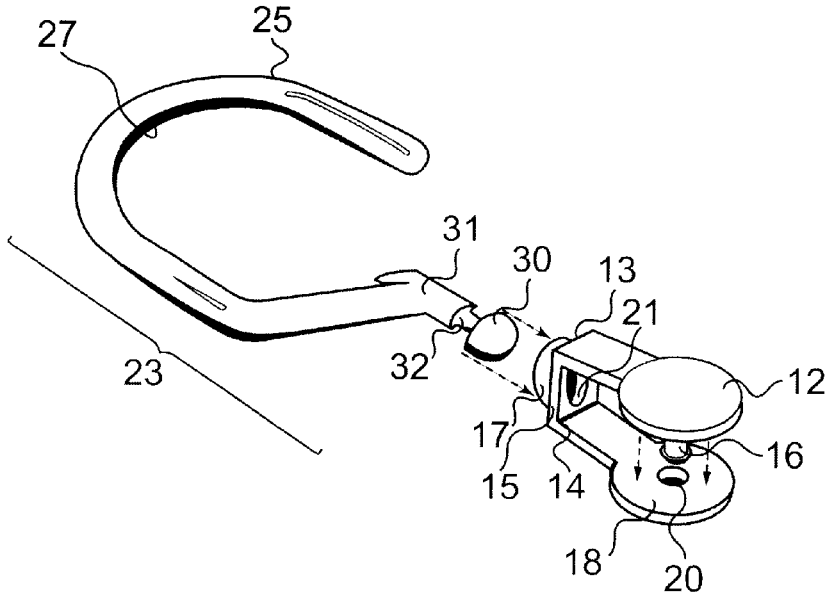
FIG. 10 shows a top front exploded view of the fastening device whereby the coupling means is separated from the attachment means.

FIG. 10 shows a top front exploded view of the fastening device in accordance with the present invention whereby the coupling means 23 is separated from the attachment means 11. FIG. 10 also shows how the coupling means 23 is attached to the attachment means 11. More specifically, the coupling means 23 has a curved, hook-like, U-shaped configuration with an extended second portion 31 having a narrow portion 32 of the extended second portion which terminates at a bulbous head 30. The narrow portion 32 of the extended second portion provides the key to rotatably attaching the attachment means 11 to the coupling means 23 and making the attaching of the attachment means 11 to the coupling means 23 permanent. Alternatively, if the attachment means is not rotatable, the fastening device can be molded as one piece with the coupling means. The coupling means 23 has a receiving surface 27 to receive and/or slidably couple to a substantially fixed object 9. The attachment means 11 can be made from blow-molding and/or mold injection and both the coupling means 23 and the attachment means 11 can be made from any material in any color to achieve its intended function of securing a sheet material at one end and slidably attach the attachment means 11 with sheet material 22 to a substantially fixed object 9. The attachment means 11 has a horizontal bridge 15 having a recess 21 through the center of the bridge 15 at one end and a sleeve 17 at another end of the bridge to receive the extended second portion 31 of the coupling means 23. There are two elongated members that are parallel to each other and each has a first end 13, 14 respectively, and a second end 12, 18 respectively. The second end of the first elongated member has an exterior surface and an interior surface and the interior surface has an extending member 16 disposed at the center of the interior surface of the second end of the first elongated member. The second end of the second elongated member has an exterior surface and an interior surface and the interior surface defines a corresponding recess 20 to receive the extending member 16. Therefore, when the fastening device of the present invention is in use, the extending member 16 is matingly engaged with the recess 20 to provide a tight fit.

Figure 11:
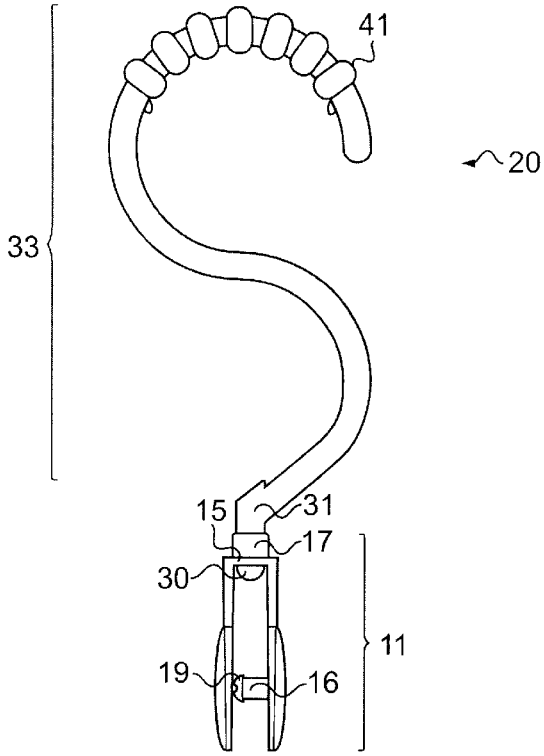
FIG. 11 shows a perspective view of the second embodiment of the fastening device having optionally round beads disposed on the coupling means to facilitate movement of the fastening device on a substantially fixed object.

FIG. 11 shows a second embodiment of the present invention whereby the coupling means 33 is S-shaped and the exterior of the receiving surface optionally has circular beads 41. The circular beads disposed on the opposite side of the receiving surface facilitate the movement of the fastening device on any object it couples to. The coupling means 33 has an extended second portion 31 having a bulbous head 30 that pierces the recess 21 disposed on bridge 15 to connect with attachment means 11 via sleeve 17 and recess 21. The attachment means has extending member 16 and bulbous head 19 that is slightly larger in diameter.

Figure 12:
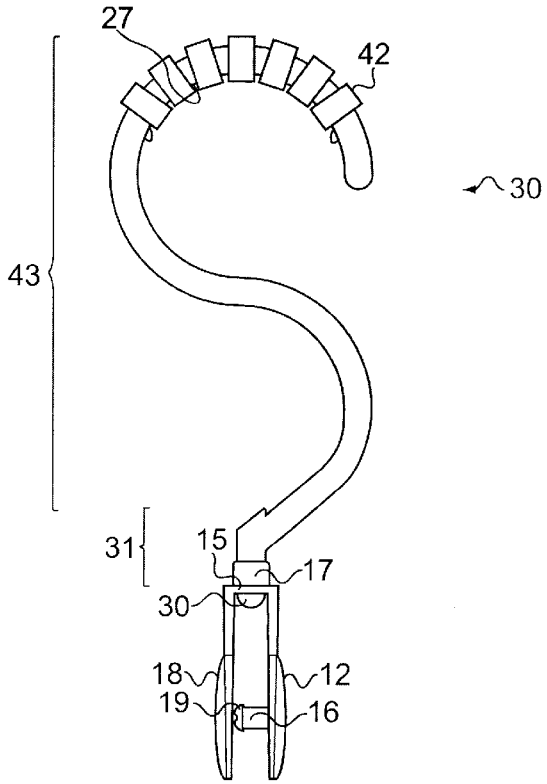
FIG. 12 shows a perspective view of the third embodiment of the fastening device having optionally square beads disposed on the coupling means to facilitate movement of the fastening device on a substantially fixed object.

FIG. 12 shows a third embodiment of the present invention whereby the coupling means 43 is S-shaped and the exterior of the receiving surface 27 has rectangular beads 42 disposed on it in order to facilitate movement of the fastening device when coupled to a substantially fixed object. The coupling means 43 has an extended second portion 31 that facilitates the engagement of the attachment means to the coupling means.

Figure 13:
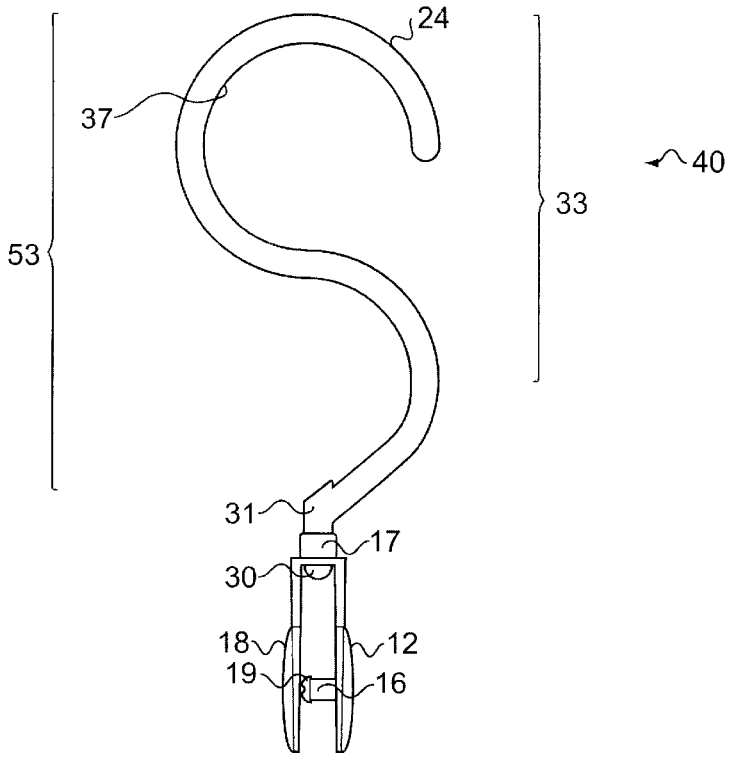
FIG. 13 shows a perspective exploded view of the fourth embodiment of the fastening device, the device having a rotatable attachment means.
Figure 14:
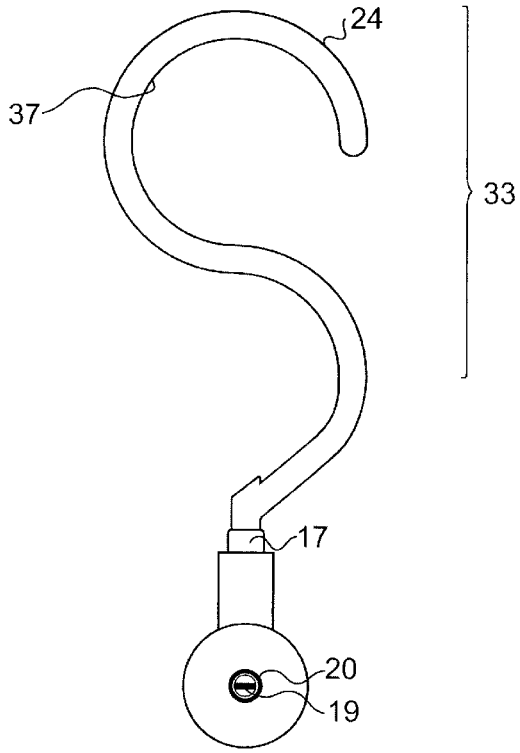
FIG. 14 shows a perspective view of the fourth embodiment of the fastening device, the attachment means is rotatable.

FIGS. 13 and 14 show a fourth embodiment of the present invention wherein the coupling means 53 is S-shaped and has an extended second portion 31 having a bulbous head 30 that engages with the attachment means 11 through sleeve 17 and recess 21 disposed on the bridge 15. Extending from both edges of the bridge 15 are two extending members each having a first end and a second end respectively. The second end of the first elongated member 12 has an extending member 16 and the second end of the second elongated member 18 has a recess 20 to receive a bulbous head 19 of the extending member thus, when the attachment means 11 is in use (as shown in FIG. 13), it can secure a sheet material between the extending member 16 and recess 20. Additionally, the attachment means 11 is rotatably attached to the coupling means 53. Therefore, when the fastening device is in transit (as shown in FIG. 14), the attachment means 11 parallels coupling means 53 and both are in the same plane, and when the fastening device is in use the attachment means 11 can be rotated so as to become perpendicular to the coupling means (as shown in FIG. 13) in order to receive a sheet material 22. FIG. 13 shows the configuration of the attachment means 11 in use where the bulbous head 19 of the extending member 16 pierces, penetrates and protrudes through the recess 20 of the second end of the second elongated member.

Figure 15:
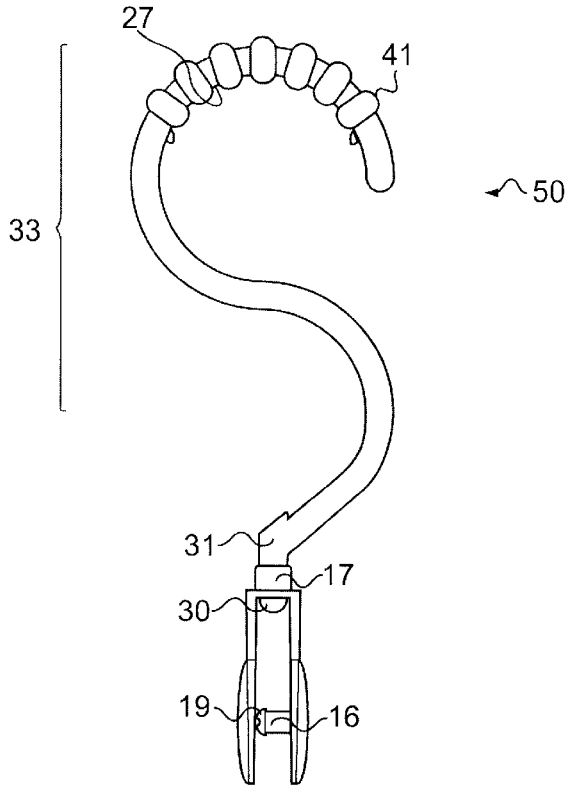
FIG. 15 shows an exploded perspective view of the fifth embodiment of the fastening device whereby the attachment means is rotatable and the coupling means has beads to enable the movements of the fastening device on the substantially fixed object.
Figure 16:
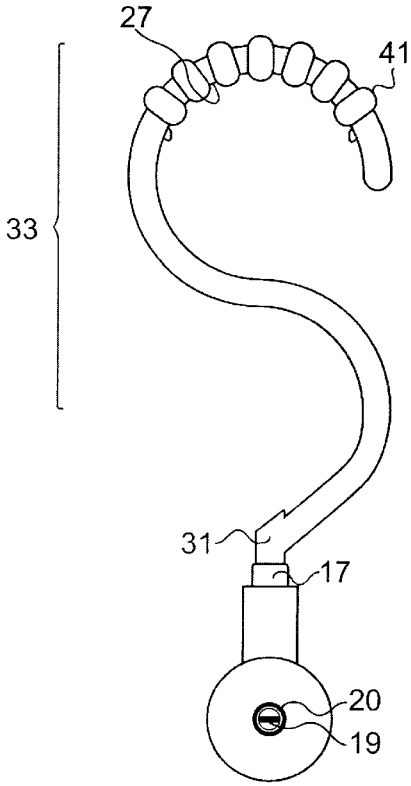
FIG. 16 shows a side perspective view of the fifth embodiment whereby round beads are disposed on the coupling means to facilitate movement of the fastening device and the attachment means is rotated to expose the tip of the extending member as it is matingly engaged with its corresponding recess.

FIGS. 15 and 16 show a fifth embodiment of the present invention wherein the coupling means 33 is S-shaped and has circular and/or round beads disposed on the opposite surface of the receiving surface of the coupling means 33. Coupling means 33 has an extended second portion 31 and a bulbous head 30 that pierces recess 21 via sleeve 17. The bulbous head 30 has a slightly bigger diameter than recess 21 in order to ensure that the coupling means 33 will stay locked into the recess 21 and also to ensure a permanent attachment to the attachment means 11. The attachment means 11 is rotatably attached to the coupling means. A sheet material 22 is fastened to the attachment means 11 via pressing the extending member 16 towards recess 20 thus, FIG. 16 shows the configuration when the extending member 16 is lodged in recess 20.

Figure 17:
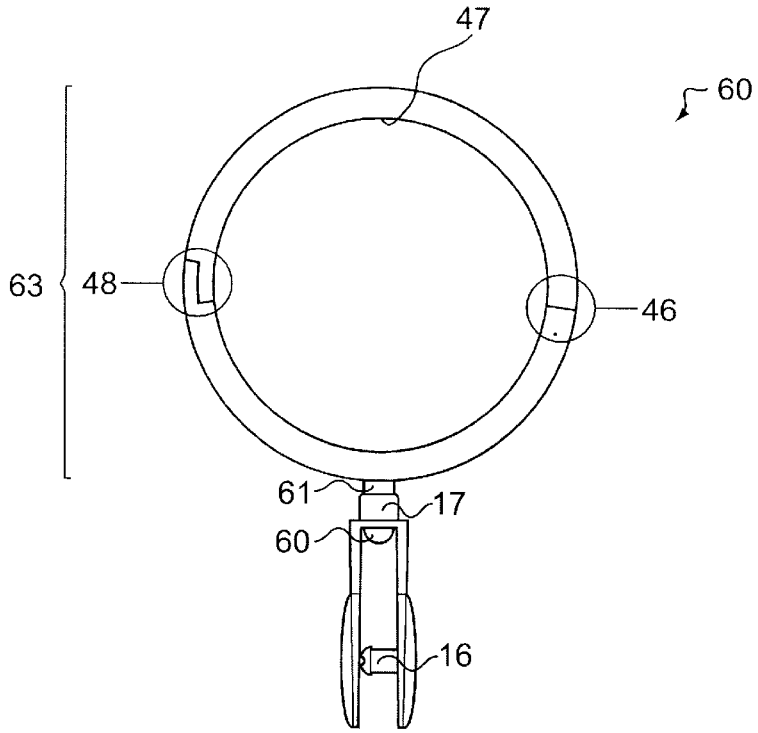
FIG. 17 shows an exploded view of the sixth embodiment whereby the coupling means is a circular ring having a hinge and locking mechanism and the attachment means is attached to the coupling means.
Figure 18:
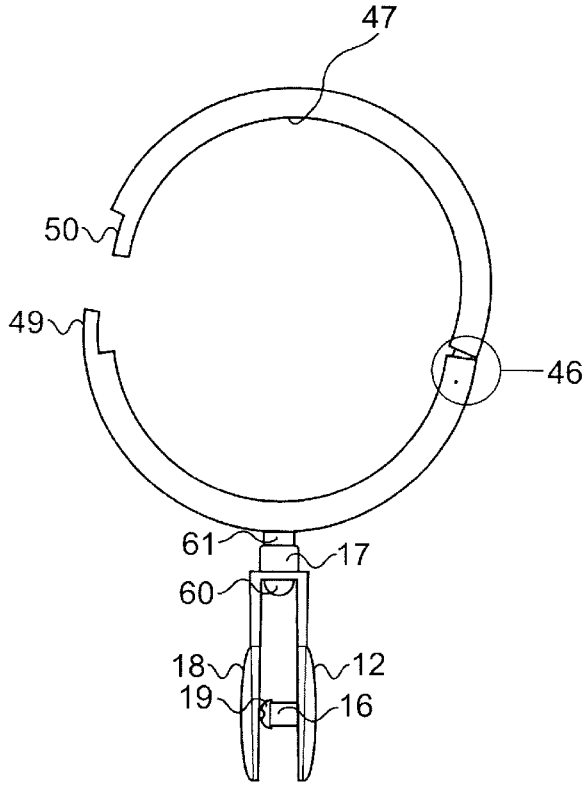
FIG. 18 shows an exploded view of the sixth embodiment whereby the coupling means is open.

FIGS. 17 and 18 show a sixth embodiment of the present invention whereby the coupling means 63 is circular and made from two halves connected at one end by a hinge 46 and a locking mechanism 48 that has two engaging parts. The first engaging part 50 includes a protrusion and a second engaging part 49 defines a corresponding recess to receive the protrusion and the two engaging parts can be locked by a friction fit. Coupling means 63 in FIG. 17 shows the coupling means in a locked position and FIG. 18 shows it in an unlocked position. The coupling means 63 has an extended second portion 61 extending from coupling means 63 and the extended second portion 61 has a bulbous head 60 that secures the coupling means 63 to attachment means 11. Attachment means 11 has extending member 16 and bulbous head 19 that is matingly fitted with recess 20.

Figure 19:
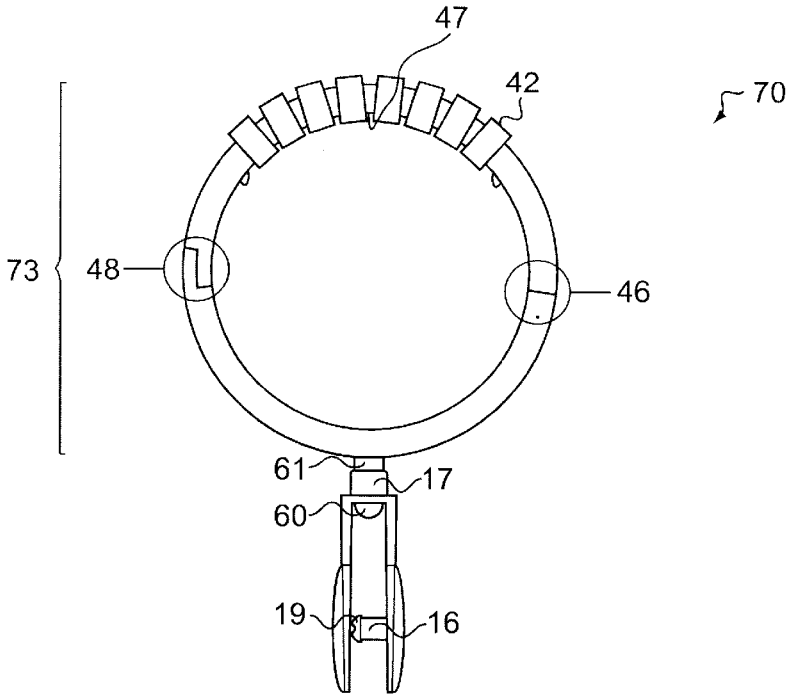
FIG. 19 shows an exploded view of the seventh embodiment having rectangular beads disposed on the coupling means.
Figure 20:
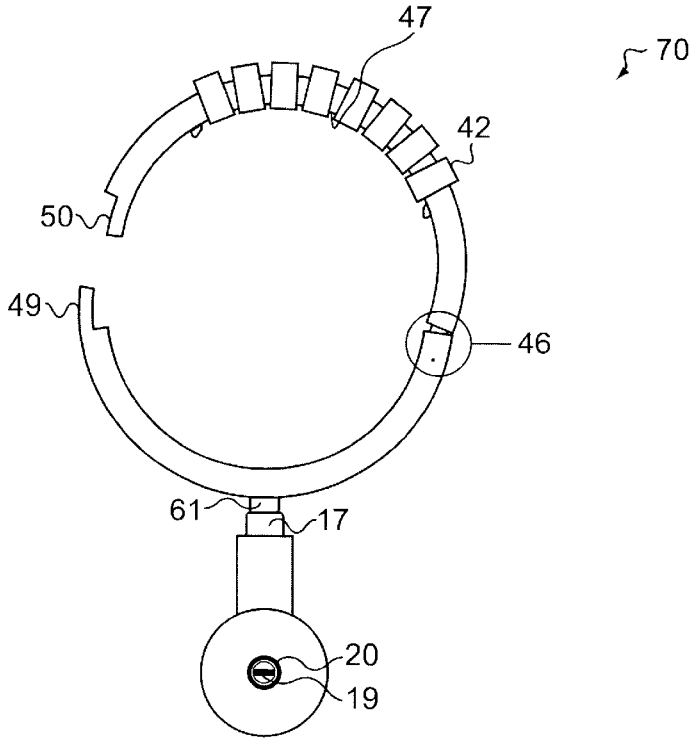
FIG. 20 shows an exploded view of the seventh embodiment having rectangular beads disposed on the coupling means and the attachment means is rotatable.

FIGS. 19 and 20 show a seventh embodiment of the present invention whereby the coupling means 73 is circular and has rectangular beads 42 disposed on the opposite surface of the receiving surface 47 to facilitate the movement of the fastening device when coupled on a substantially fixed object. The coupling means 73 is circular and is made by connecting two halves at one side by a hinge 46 and at the other by a locking mechanism 48. FIG. 19 shows the coupling means in a locked position and FIG. 20 shows the coupling means in an unlocked position. Like FIGS. 17 and 18, the locking mechanism 48 has two engaging parts, a first engaging part has a protrusion 50 and a second engaging part has a recess 49 to receive the protrusion 50 so, when the two engaging parts are engaged with each other, the surface of the coupling means 73 is smooth and the locking mechanism 48 blends into the coupling means 73 so as to hide the locking mechanism or make the locking mechanism invisible. The coupling means 73 has an extended second portion 61 having a bulbous head 60 to secure itself to the attachment means 11. The attachment means 11 is rotatable as can be seen in FIGS. 19 and 20.

Figure 21:
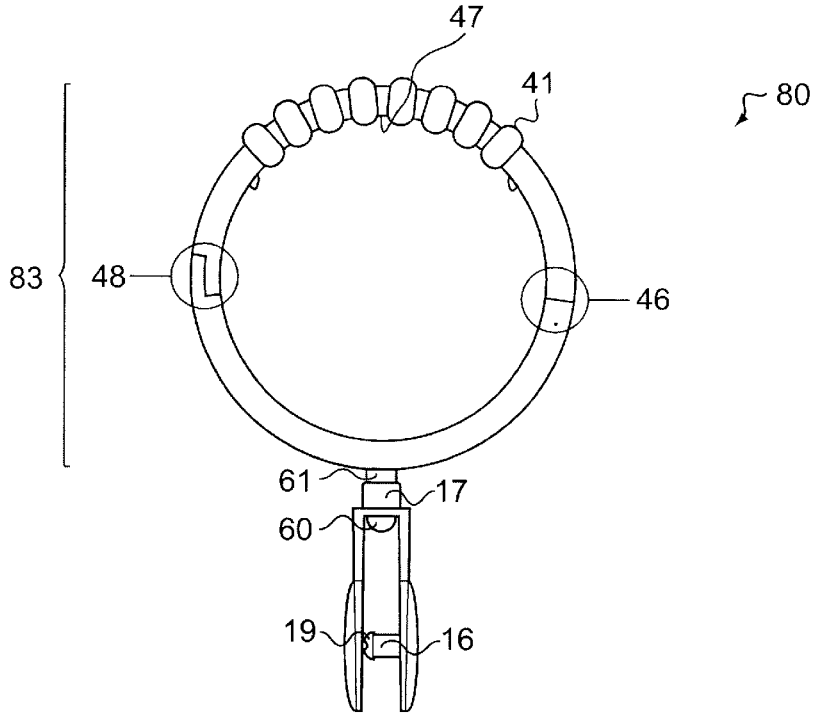
FIG. 21 shows an exploded view of the eighth embodiment having circular beads disposed on the coupling means.
Figure 22:
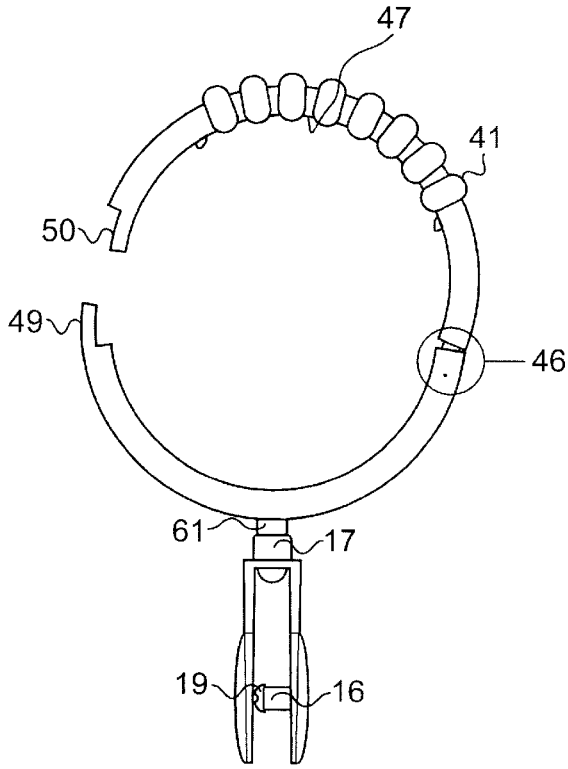
FIG. 22 shows an exploded view of the eighth embodiment having circular beads disposed on the coupling means wherein the protrusion and a recess to receive the protrusion are not engaged.

FIGS. 21 and 22 show an eighth embodiment of the present invention wherein the coupling means 83 is circular and made from two halves connected by a hinge 46 on one side and by a locking mechanism 48 on the other side. There are circular beads 41 disposed on the opposite surface of the receiving surface 47 to facilitate movement of the fastening device 80 when coupled to a substantially fixed object. The coupling means 83 has an extended second portion 61 which pierces through bridge 15 by entering sleeve 17 and the extended second portion 61 has a bulbous head 60 that is slightly larger than the diameter of recess 21 so, when the extended second portion 61 enters the sleeve 17 and passes through recess 21, it will be permanently lodged and would prevent the extended second portion 61 from re-exiting recess 21. The attachment means 11 is fixed to the coupling means 83 and thus, not rotatable. The attachment means 11 has an extending member 16 having a bulbous head 19 which will be matingly fitted with recess 20.

Figure 23:
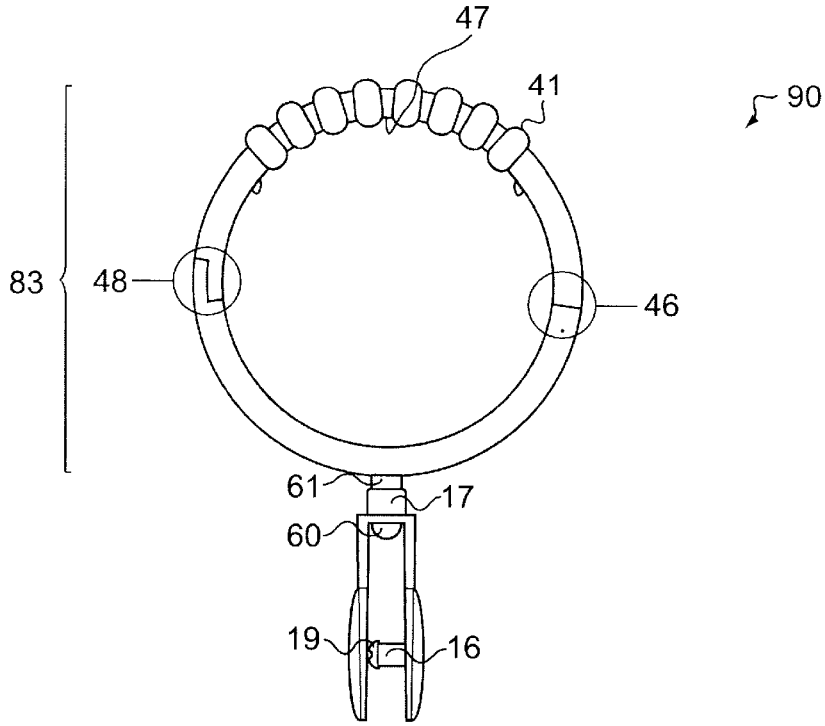
FIG. 23 shows an exploded view of the ninth embodiment whereby the attachment means is rotatable and there are round beads disposed on the coupling means.
Figure 24:
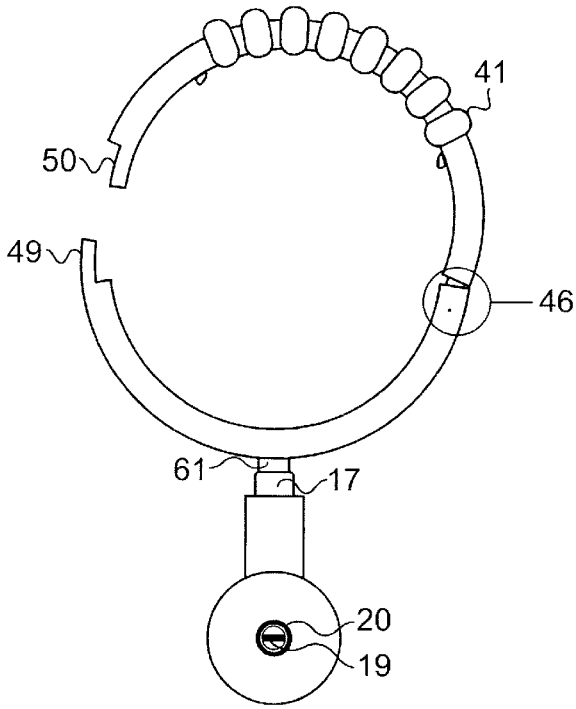
FIG. 24 shows an exploded view of the ninth embodiment of the present invention whereby round beads are disposed on the coupling means and the attachment means is rotatable.

FIGS. 23 and 24 show a ninth embodiment of the present invention wherein the coupling means 83 is circular and has circular beads 41 disposed on the opposite surface of the receiving surface 47. The circular beads 41 facilitate movement of the fastening device on a substantially fixed object when coupled. The coupling means 83 is made from two halves connected at one end by a hinge 46 and at the other end by a locking mechanism 48 which includes two engaging parts. Engaging part 50 has a protrusion and engaging part 49 has a recess to receive the protrusion and so when engaging part 50 locks with engaging part 49 by a friction fit, the position of the lock becomes invisible thus to create an appearance of a continuous circle. The attachment means 11 is attached to the coupling means 83 through the extended second portion 61 having a bulbous head 60. The attachment means further comprises a fastening device to receive and fasten a sheet material to the attachment means 11 by the extending member 16 piercing the sheet material and be matingly engaged with a recess 20 that has a diameter slightly smaller than the bulbous head 19 disposed at the end of the extending member 16, in order to create a snug fit and to prevent the sheet material from disengaging from the attachment means 11. The attachment means 11 is rotatably connected to coupling means 83. FIG. 24 shows a rotated attachment means 11 from the attachment means 11 in FIG. 23.

Figure 25:
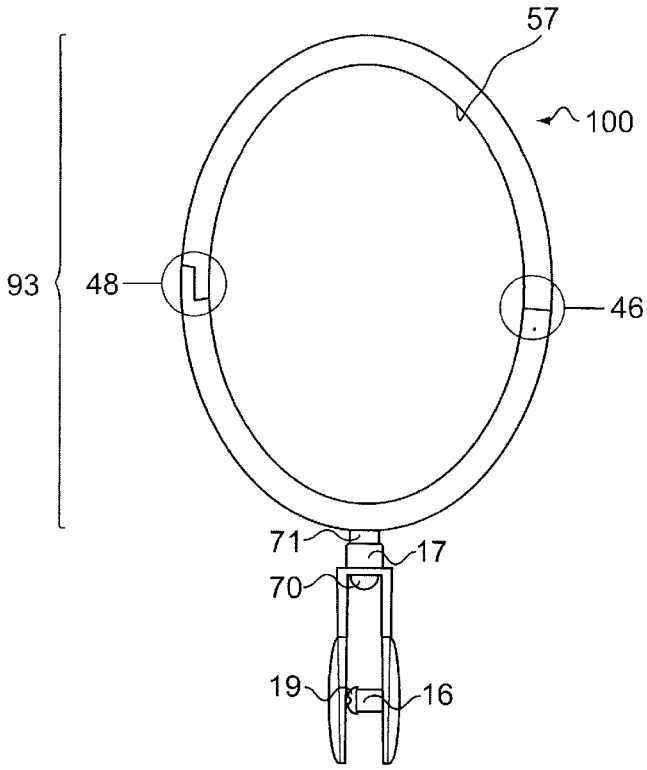
FIG. 25 shows an exploded view of the tenth embodiment of the present invention whereby the coupling means is an oval ring having a hinge and a locking mechanism and the attachment means is connected to the oval coupling means.
Figure 26:
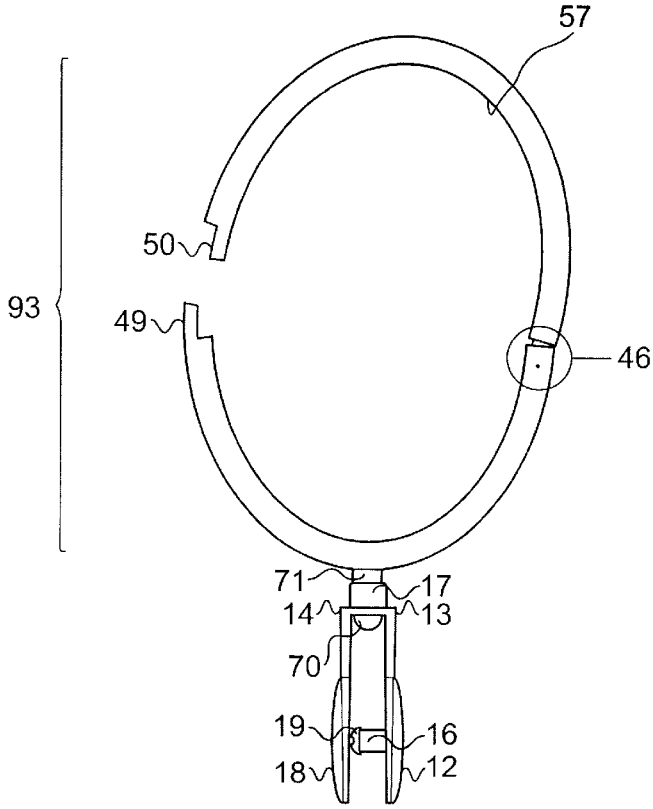
FIG. 26 shows an exploded view of the tenth embodiment of the present invention whereby the locking mechanism is not engaged.

FIGS. 25 and 26 show a tenth embodiment of the present invention wherein the coupling means 93 is oval-shaped and is made from two half ovals connected at one end by a hinge 46 and at the other by a locking mechanism 48 having two separate, but corresponding engaging parts. Thus when the two corresponding engaging parts 49 and 50 respectively are engaged with each other, it would provide the appearance of a continuous one piece oval coupling means without the locking mechanism being visible. The engaging part has a protrusion 50 and a corresponding recess 49 to receive the protrusion 50. FIG. 26 shows the coupling means 93 at an open position. The coupling means 93 is further comprised of an extended second portion 71 having a bulbous head 70 that is fixably engaged with the attachment means 11 through sleeve 17 disposed on bridge 15 and above recess 20. Once the coupling means 93 is properly engaged with attachment means 11, the bulbous head 70 will prevent the extended second portion 71 from disengaging itself from the attachment means 11. The attachment means 11 is attached to the coupling means 93 permanently and not rotatably. The attachment means 11 has a bridge 15 having two elongated members connected to either edge of the bridge 15. Above the bridge 15 is a sleeve 17 to receive the extended second portion 71 and a recess 21 to receive the extended second portion 71. The two elongated members have their respective first ends 13 and 14 and their respective second ends 12 and 18. These elongated members face each other and the interior surface of the second end of elongated member 12 has an extending member 16 having a bulbous head 19 and the interior surface of the second end of elongated member 18 has a recess 20 that can be correspondingly engaged to the extending member 16. Accordingly, a sheet material can be fastened by the attachment means by positioning the sheet material between the extending member 16 and recess 20, then put pressure on extending member 16 and bring it toward recess 20 in order to lock the sheet material in place. In application of the present invention, a user can first place the sheet material between the extending member 16 and recess 20 to bring closure to the extending member and recess ensemble. Then the user can open the locking system 48 and wrap the two halves with the coupling means 93 around a substantially fixed object and then close the locking mechanism as shown in FIG. 25.

Figure 27:
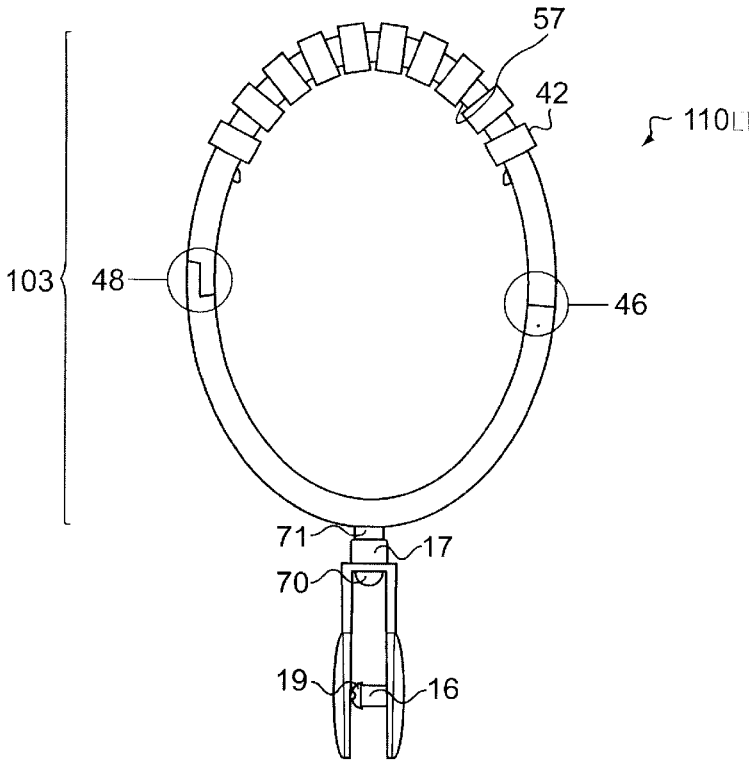
FIG. 27 shows an exploded view of the eleventh embodiment of the present invention wherein rectangular beads are disposed on the coupling means to facilitate the movement of the fastening device and the coupling means is oval-shaped and the attachment means is rotatable.
Figure 28:
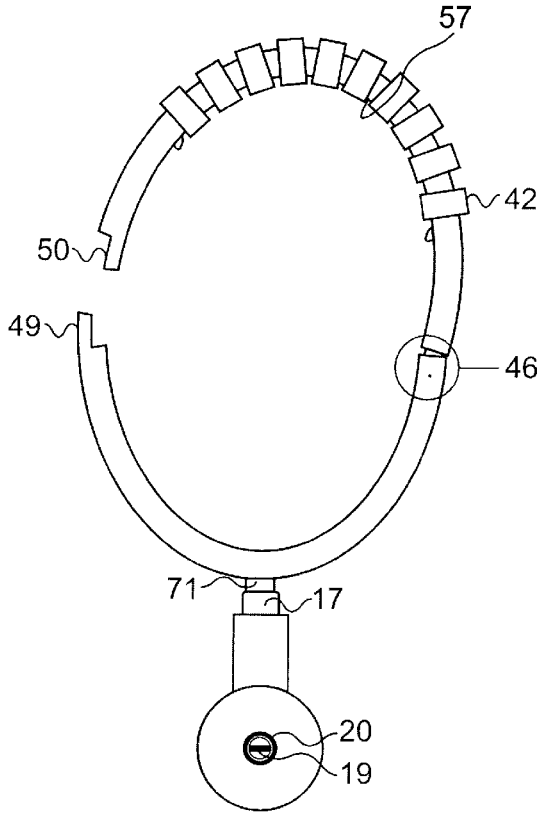
FIG. 28 shows an exploded view of the eleventh embodiment of the present invention wherein rectangular beads are disposed on the oval coupling means and the oval coupling means is in its open position.

FIGS. 27 and 28 show an eleventh embodiment of the present invention fastening device with a movable and rotatable attachment means 11. The coupling means 103 is oval-shaped having rectangular beads disposed on the opposite surface of the receiving surface 57 of the oval-shaped coupling means 103. These rectangular beads can be in any shape desired and can be made from any material. These beads 42 facilitate the movement of the fastening device when it is coupled with a substantially fixed object. The coupling means 103 is made from two half ovals joined at one end by a hinge 46 and at the other end a locking mechanism having two corresponding engaging parts 49 and 50 respectively. The coupling means 103 has an extended second portion 71 having a bulbous head 70 that is slightly larger than recess 21 so that the extended second portion 71 can enter and go through recess 21 but cannot back out once the bulbous head 70 of the extended second portion 70 goes through recess 21. Thus, the attachment means 11 cannot be easily separated from coupling means 103. The attachment means 11 is rotatably attached to the coupling means 103. Thus, when the fastening device of the present invention is in use, the attachment means 11 is rotated 90 degrees as shown in FIG. 28. The recess 20 of the attachment means 11 may be a recess or it may be a through hole. FIG. 28 also shows the coupling means 103 in an open position ready to couple with a substantially fixed object.

Figure 29:
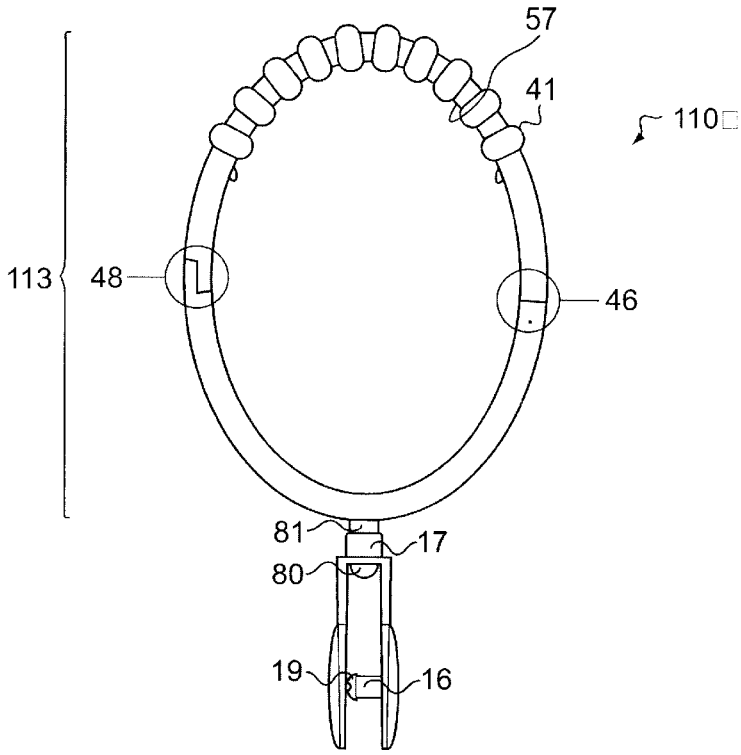
FIG. 29 shows an exploded view of the twelfth embodiment of the present invention wherein circular beads are disposed on the oval-shaped coupling means and the attachment means is attached to the coupling means.
Figure 30:
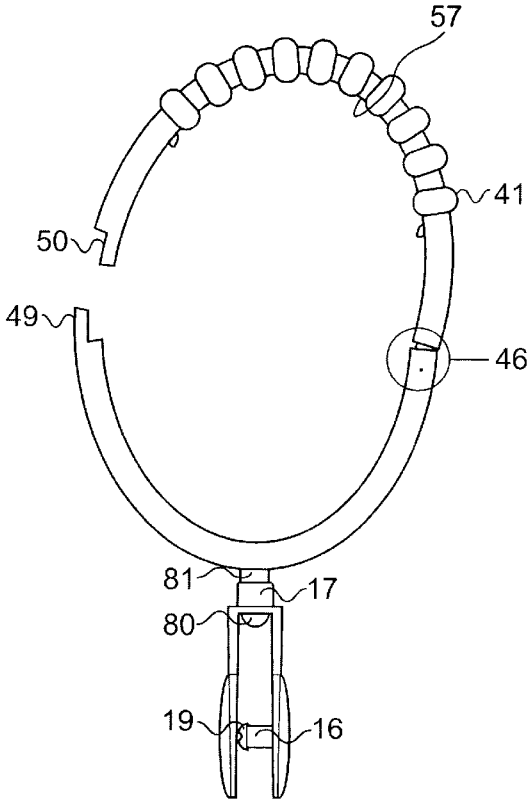
FIG. 30 shows an exploded view of the twelfth embodiment of the present invention wherein circular beads are disposed on the oval-shaped coupling means and the attachment means is attached to the coupling means and the coupling means is in an open position.

FIGS. 29 and 30 show a twelfth embodiment of the present invention with an oval-shaped coupling means 113 having circular beads 41 disposed on the opposite surface of receiving surface 57. The circular beads 41 can also be made in rectangular, in triangular or in any shape desired, such as little flowers or snowflakes or animations of any cartoon, fictitious or real-life persons, to match the sheet material to which it is attached or to match and complement the decor. The coupling means 113 is made from two half ovals connected at one end by a hinge 46 and at the other end by a locking mechanism 48. The locking mechanism, in addition to the corresponding engaging means thus far described, can also be any conventional locking mechanism such as a male adaptor and a female receiver, a friction lock, a pressure lock or any other lock that can join two pieces together. The coupling means 113 is provided with an extended second portion 81 having a bulbous head 80 that is pushed through recess 21 and lodged in recess 21. The attachment means 11 is not rotatably attached to the coupling means 113. FIG. 30 shows the coupling means in an open position where the locking mechanism is disengaged. The attachment means 11 is as previously described.

Figure 31:
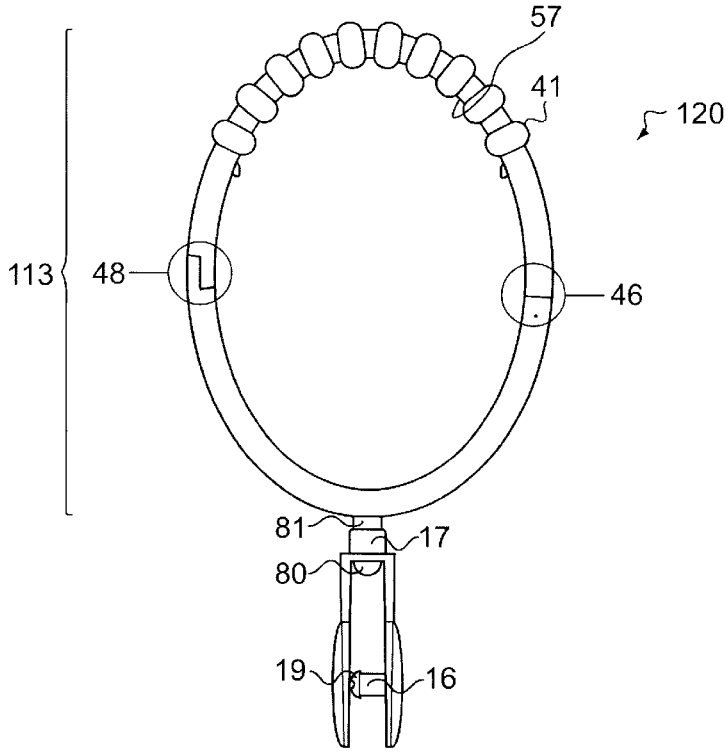
FIG. 31 shows an exploded view of the thirteenth embodiment of the present invention wherein circular beads are disposed on the oval-shaped coupling means and the attachment means is removably attached to the coupling means.
Figure 32:
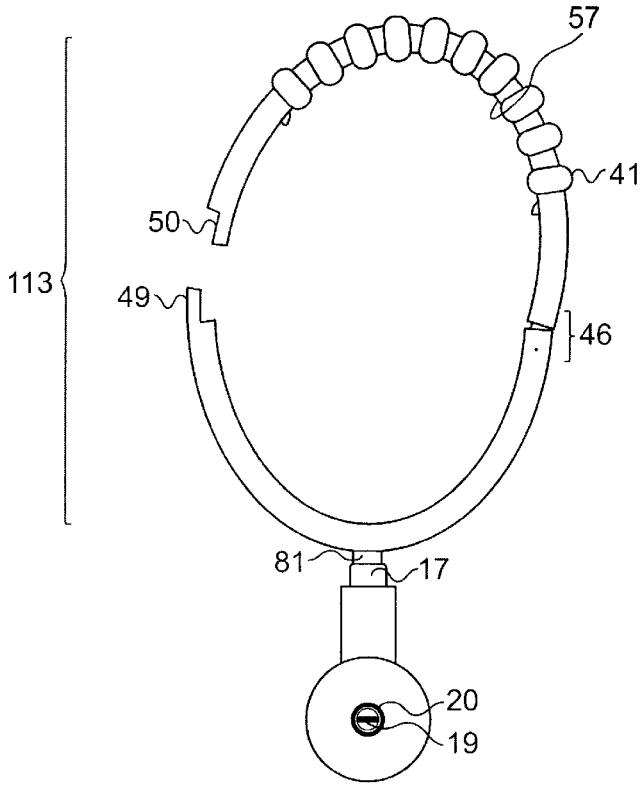
FIG. 32 shows an exploded side view of the thirteenth embodiment of the present invention wherein circular beads are disposed on the oval-shaped coupling means and the attachment means is removably attached to the coupling means and the coupling means is in an open position.

FIGS. 31 and 32 show a thirteenth embodiment of the present invention with an oval-shaped coupling means 113 having circular beads 41 disposed on the opposite surface of the receiving surface 57. The beads 41 can be of any shape and can be made from any material. The beads 41 facilitate the movement of the fastening device of the present invention when the fastening device is slidably coupled to a substantially fixed object. The coupling means 113 is made from two half ovals joined at one end by a hinge 46 and at the other end by a locking mechanism 48. The coupling means 113 has an extended second portion 81 opposite the receiving surface 57 so as to attach itself to an attachment means. The extended second portion 81 is positioned such that it divides the coupling means 113 into two equal halves so as to ensure the fastening device will remain upright. The attachment means 11 is rotatably attached to the coupling means 113. Thus, FIG. 32 illustrates the attachment means 11 when the fastening device is in use and it also illustrates the coupling means 113 in an open position. Accordingly, FIGS. 31 and 32 show attachment means 11 is freely rotatable with respect to the coupling means and that the attachment means 11 is at a different rotation when it is in use than during shipping, where it will be rotated 90 degrees in order to reduce and minimize space required.

While the invention has been described with respect to use as a connector and/or a fastening device to connect between a sheet material and a substantially fixed object, it is to be understood the invention can be used to connect between two sheet materials or any two objects. It is further to be understood that the fastening device of the present invention can be made from any method, such as injection molding, blow-molding or any conventional method and can be made from any material synthetic or natural in any colors. The material and object to be fastened and connected by the present invention are not necessarily limitations of the invention.

It is to be further understood that any utilitarian description herein of any component of the fastening device of the present invention, for example, the coupling means, the beads or any feature thereon, or the attachment means, or any feature, i.e. any feature thereon, is not to be construed as a statement that the appearance of any component of the invention is functional in nature or dictated by function. Surface ornamentation or configuration of the fastening device or any components thereof, for example, the exterior of the fastening device, such as the coupling means or the attachment means or any portion thereof, are attributable to ornamental considerations.

The coupling means 23 and the bridge 15 are preferably formed from a substantially rigid material, including but not limited to metal, glass, plastics and thermoplastics, either opaque or transparent, preferably polypropylene and ceramics. The coupling means and the attachment means can be sculptured and/or molded, i.e., blow-molded in any form or shape desired, specifically the attachment means can be made from more flexible material that is resilient and not easily breakable and can withstand repeated use and application and also would not break, rust or change shape due to temperature and humidity changes. The fastening device should also be made from material that is childproof and when broken would not be injurious to animals or users and can easily take on any color in order to match the décor.

As can be further appreciated from the foregoing description and the illustrated embodiments, the fastening device of the present invention does not necessarily require a closed ring for the coupling means and the attachment means does not necessarily need to be rotatably attached to the coupling means or that the attachment means is necessarily a separate component from the coupling means. Thus the attachment means and the coupling means can be molded from the same mold as one piece, they can also optionally be made in two pieces and put together by conventional method or by forcing the extended second portion through the recess on the bridge. They could be made from metal and the elongated member processed by annealing and/or heat treatment in order to impute springy-like feeling to facilitate the engagement of the extending member and its corresponding recess or, they can be made from any material in any shape or form having any decoration as to the client's and/or customer's liking.

Having thus described in detail the preferred embodiments of the present invention, it is to be understood that the invention defined by the appended claims is not to be limited by particular details set forth in the above description, as many apparent variations thereof are possible without departing from the spirit or scope of the present invention.

What is claimed is:

1. An apparatus for coupling to an object, comprising coupling means for slidably coupling said apparatus to a substantially fixed object; said coupling means defining a receiving surface at a first portion thereof, and an extended second portion thereof; attachment means for attaching an object to said apparatus, said attachment means comprising two outer members coupled by a bridge, a first of said outer members comprising an extending member extending toward a second of said outer members, said second of said outer members defining a recess for receiving said extending member, said bridge defining a recess for rotatably receiving said extended second portion of said coupling means, wherein said coupling means and said attachment means are detachable from each other.

2. The apparatus as claimed in claim 1, wherein said extending member pierces a sheet material to couple said sheet material with said substantially fixed object.

3. The apparatus as claimed in claim 1, wherein said coupling means is S-shaped.

4. The apparatus as claimed in claim 1, wherein said coupling means is oval-shaped.

5. The apparatus as claimed in claim 1, wherein said coupling means is circular-shaped.

6. The apparatus as claimed in claim 1, wherein the attachment means is rotatably attached to the coupling means.

7. The apparatus as claimed in claim 1, wherein beads are optionally disposed on the receiving surface.

8. A fastening device for hanging a sheet material onto a substantially fixed object, comprising:

a coupling means for coupling to a substantially fixed object; and a fastening means having a first end connected to the coupling means and a second end facilitating the fastening of the sheet material;

wherein said coupling means and said fastening means are detachable from each other.

9. A connector for connecting a shower curtain to a rod comprising:

a rod connector comprising coupling means and attachment means detachable from each other, said rod connector being capable of contemporaneously connecting to a rod; and a shower curtain holder attached to said rod connector.

10. The connector as claimed in claim 9, wherein the shower curtain holder is comprised of an extending member and a corresponding recess on the opposite end of a bridge whereby the bridge connects the extending member and the recess.

11. The connector as claimed in claim 9, wherein beads are optionally disposed on the rod connector in order to facilitate the movement of the connector on a rod.

12. A fastening device for connecting a sheet material having at least one aperture onto a substantially fixed object, comprising:

a first component having first and second ends, wherein the first end comprises a curved hook for hanging the fastening device onto the substantially fixed object, and the second end comprises an extending member with a bulbous head; and a second component having first and second ends, wherein the first end comprises a sleeve and a recess for matingly engaging the extending member with a bulbous head of the first component, and a second end comprising means for engaging the aperture of the sheet material, such that when the sleeve and the recess of the first end of the second component is matingly engaged to the extending member with the bulbous head of the first component, the second component is connected to and freely rotatable about the first component.

13. A fastening device for connecting a shower curtain having at least one aperture onto a rod, comprising:

a first component having first and second ends, wherein the first end comprises a ring having a locking mechanism for coupling the fastening device onto a rod, and the second end comprises a bulbous male adaptor; and a second component having first and second ends, wherein the first end comprises a female adaptor for matingly engaging the bulbous male adaptor of the first component, and a second end comprising a male adaptor opposing a female receiver and connected by a bridge for matingly engaging the aperture of the shower curtain, such that when the male adaptor penetrates the aperture and matingly is engaged with the female receiver the shower curtain is fastened to the second component; and when the first end of the second component is matingly engaged to the bulbous male adaptor of the first component, the second component is connected to the first component and the shower curtain is hanging from the rod;

wherein said first component and said second component are detachable from each other.

* * * * *